United States Patent [19]

Simkanich

[11] Patent Number: 4,582,073

[45] Date of Patent: Apr. 15, 1986

[54] CHECK VALVE TYPE CIGARETTE MOUTHPIECE

[76] Inventor: John J. Simkanich, 122 Chesapeake Dr., Newtown, Pa. 18940

[21] Appl. No.: 641,683

[22] Filed: Aug. 17, 1984

[51] Int. Cl.[4] ..... A24D 1/02; A24D 1/04; A24D 1/10; A24D 3/04

[52] U.S. Cl. ..... 131/339; 131/349; 131/365; 131/215.3

[58] Field of Search ..... 131/339, 349, 215 B, 131/365, 340

[56] References Cited

U.S. PATENT DOCUMENTS 1,581,451 4/1926 Knapp ..... 131/349

3,616,802 11/1971 Marinaccio ..... 131/215 B

*Primary Examiner*—V. Millin

*Attorney, Agent, or Firm*—John J. Simkanich

[57] ABSTRACT

A check valve type cigarette mouthpiece, which can be used with a non-filter cigarette or be incorporated into the filter tip portion of a filter cigarette, incorporates a valving structure which opens automatically under a slight pressure differential created by a vacuum or draw from the smoker and is otherwise closed prohibiting the passage of gases or smoke when the cigarette is not being actively smoked.

16 Claims, 11 Drawing Figures

CHECK VALVE TYPE CIGARETTE MOUTHPIECE

BACKGROUND OF THE INVENTION

This invention relates to cigarettes and especially self-extinguishing cigarettes which go out after a few minutes of not being actively smoked, and it also relates to portions or components therefor.

Various governmental and safety services groups have been investigating the possibility of self-extinguishing cigarettes in an effort to cut down on the numbers of injuries and deaths caused by unattended lighted cigarettes. Such unattended lighted cigarettes can be knocked over by children or pets, dropped accidentally or dropped when the smoker falls asleep in bed. Burns or fires often result.

Research has been conducted and continues in the technology of fire-safe cigarettes. These efforts have been directed towards fire retardant cigarette tube wrappers, i.e., cigarette paper, and cigarette paper which promotes the extinguishing of the lighted tobacco and other filler material once the cigarette is dropped or placed in an ashtray.

However, this solution to fire-safe cigarettes is short-sighted, as it will not promote extinguishment of the cigarette when the cigarette falls or is placed in other than the horizontal or reasonably horizontal position.

When a lighted cigarette is placed at an angle of 30 degrees or greater, especially, greater than 45 degrees from horizontal, a "chimney effect" is created. This is true even with filtered cigarettes. This chimney effect is caused by the gases of combustion rising and creating a forced draft which promotes continued combustion.

With this "chimney effect" in operation, a lighted cigarette continues to burn even when not being smoked, thereby defeating the extinguishing properties of the tube wrapper. The burn and fire hazard will thereby remain in a large number of circumstances involving unattended, lighted, self-extinguishing cigarettes.

An object of the present invention is to provide a safe, self-extinguishing cigarette which is not subject to continuous burning when unattended due to "chimney effect".

A second object of the present invention is to provide a valving mouthpiece for cigarettes which valves off the flow of gases and smoke in the absence of a negative pressure created by a smoker's "drawing" action.

A third object of the present invention is to incorporate this valving mouthpiece into a cigarette filter.

A further object is to adjust the amount of draw—negative pressure—needed to be created by a smoker to get the valving mouthpiece to pass gases and smoke, automatically.

SUMMARY OF THE INVENTION

The objects of this invention are realized in a valving mouthpiece for cigarettes. The valving structure opens automatically under a negative pressure created by a smoker's drawing action and closes off otherwise.

The valving structure can be mounted on a disk positioned within a cigarette mouthpiece or positioned within a cigarette holder, either of which being attached to or otherwise positioned over the end of a cigarette. The valving structure can also be incorporated as part of or within the layered filter material itself, for use on filter-tipped cigarettes.

Such valving structure is normally biased to the closed position and opens outwardly toward the smoker's mouth under the negative pressure created by a smoker's drawing action.

The incorporation of the valving structure on a cigarette having a fire-safe type extinguishing promoting tube wrapper thereby provides a self-extinguishing cigarette which will not continue to burn even when lying vertical or almost vertical.

DESCRIPTION OF THE DRAWINGS

The features, operation and advantages of this invention will become readily apparent from a reading of the following Detailed Description of the Invention in conjunction with the accompanying drawings in which like numerals refer to like elements, and in which.

DETAILED DESCRIPTION OF THE INVENTION

Figure 1:
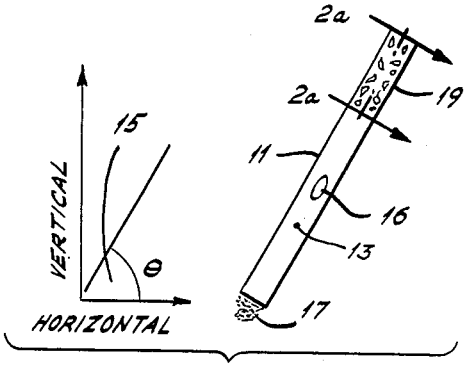
FIG. 1 shows an unattended lighted cigarette which is positioned canted from horizontal and which will not pass gases and smoke along the length of the cigarette under a chimney effect because of a valved mouthpiece.
Figure 4A:
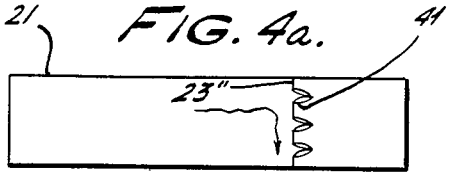
FIGS. 4*a* and 4*b* show cross-sectional views of a puffed-cell embodiment of the invention, in the closed and opened states, respectively.
Figure 4B:
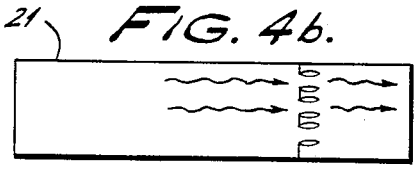
Figure 2A:
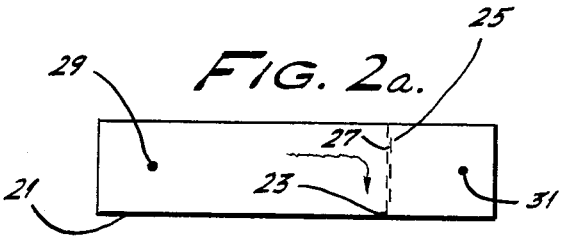
FIGS. 2*a* and 2*b* show cross-sectional views of the closed and opened states, respectively, of a flapper-type valve positioned within a cigarette mouthpiece or at the end of a filter tip shown in FIG. 1.
Figure 2B:
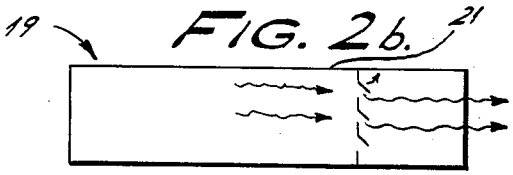
Figure 5A:
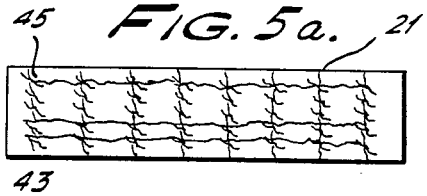
FIGS. 5*a* and 5*b* show cross-sectional views of a flapper-type valve structure incorporated into the layers of a filter.
Figure 5B:
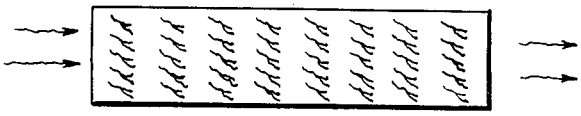
Figure 3A:
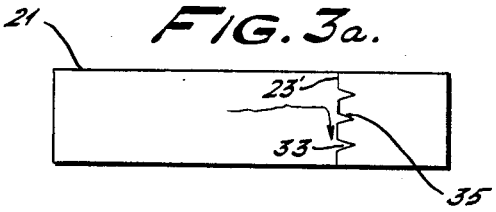
FIGS. 3*a* and 3*b* show cross-sectional views of the closed and opened states, respectively of an alternate embodiment, a bladder-type valving structure positioned within a cigarette mouthpiece or at the end of a filter tip.
Figure 3B:
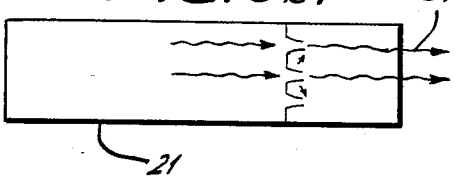
Figure 6A:
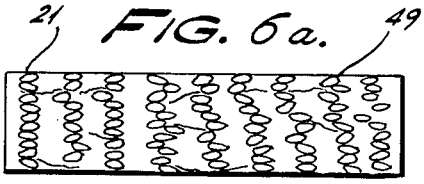
FIGS. 6*a* and 6*b* show cross-sectional view of a puffed-cell embodiment of the invention, in the closed and open states, respectively, as incorporated into the layers of a filter.
Figure 6B:
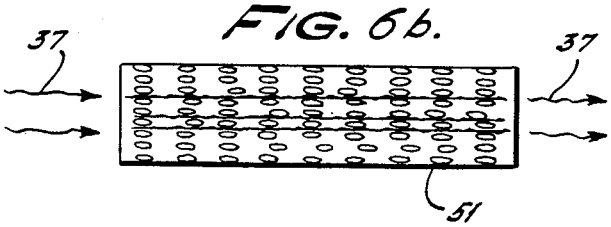

A lighted cigarette 11, FIG. 1, will continue to burn when unattended, no matter what type of flame extinguishing or flame retardant wrapper 13 (cigarette paper) it is made from, if the cigarette 11 is placed in the tilted position at an angle "theta" 15 from horizontal. This is especially true when the angle 15 is greater than 45 degrees and is even more true when the angle 15 approaches 90 degrees, so that the lighted cigarette is standing almost vertically. This is because the natural flow of smoke and gases created at the burn cone area 17 continues to travel up the cigarette "tube" formed by the wrapper 13, even though a normal filter or filter tip is placed as the mouthpiece end of the cigarette.

A fire safe cigarette 11 will have a wrapper 13 which will inhibit the cross flow of air transversely or sidewise into the filler material 16. Air and gases can, however, pass through the end of the cigarette ash and up the roll of filler material 16. When a valved tip 19 is incorporated as part of the cigarette 11, the passage of gases and smoke up through the cigarette 11 is stopped. If the wrapper 13 is made of flame extinguishing or flame retardant materials, there is no chimney effect created within the cigarette 11 tube and the unattended cigarette 11 flame 17 suffocates or extinguishes after a short period of time.

The valved tip 19 is necessary as it leads to extinguishment of the cigarette flame 17 no matter what physical position the unattended cigarette 11 is in.

The valved tip 19 has a hollow solid-walled cylindrical tube 21 made of paper, plastic or other material, FIG. *2a.* Positioned traversely across the interior of this tube 21 is a mounting plate or disk 23. A single valve flap or a plurality of valve flaps 25 are positioned on the disk 23 and are normally closed, closing off one or more perforations, holes or ports 27 in the disk 23 over which each respective flap 25 is positioned. These flaps 25 are biased to the flat or closed position and bend or otherwise open under a pressure differential, i.e. a vacuum created by the "draw" of a smoker. The flaps 25 can be made of any reasonably flexible material such as paper, plastic or rubber which can be imparted with a "memory" to return to the closed position.

The flaps 25 need not be made that strong as they need only flex to the open position when the smoker draws on the cigarette. The average cigarette undergoes on the average a mere 7 to 15 "drags" or "draws" during its use. The bias or resiliency of the flaps 25 can be predetermined to establish the amount of vacuum needed to open the flaps 25. Factors which help determine this vacuum value include thickness, texture and composition from which the flaps 25 are made as well as the numbers thereof. The flaps 25 and disk 23 can be made as one piece or the flaps 25 can be mounted or cemented on the disk 23.

Traditional filter material can be packed in the tube 21 at a position 29 before or at a position 31 after the valve disk 23. Space must be allowed for the operation of the flaps 25.

An average smoker can draw, i.e., create a suction or vacuum of about $\frac{1}{2}$ inches to about $1\frac{1}{4}$ inches of water, comfortably. This suction opens the flaps 25, FIG. *2b.* When an unattended cigarette 11 is positioned in the vertically standing position, the gas pressure on the closed valve disk 23, i.e. the pressure difference across the disk 23, is less than a pressure of about $\frac{1}{4}$ inches of water and the flaps 25 remain closed, FIG. *2a.*

The disk 23', FIG. *3a,* can be made to contain a plurality of openings. The number of these openings determines the back pressure created by a valved mouthpiece 19. Bladder type valves 35 separate to open and can be made to open more easily, FIG. *3b,* to allow a passage of gases and smoke 37, than do flapper type valves 25. When a negative pressure is created on the smoker's side 39 of these bladders 35, they separate, allowing the flow of smoke. Otherwise, they are resiliently biased to the closed position, FIG. *3a.*

These bladders 35, as well as the disk 23' on which they are mounted can be made of a single drawn material, such as a resin, or of a natural organic fiber, such as a cotton, or of paper or a composition material. The force of air or gas pressure, i.e. the vacuum, which causes them to open can also be adjusted from as little as $\frac{1}{8}$ inch to as high as 8 inches of water, expressed as a measure of pressure.

Hollow cells 41, FIG. *4a,* as those created in fibers, cellulose and resin materials can also be used as the valve gates. These cells 41 can be air filled or hollow. They are mounted on a perforated disk 23'' in such a manner as to close off the holes therein and to separate or open under a smoker's draw, FIG. *4b.* Pairs of these cells 41 can meet to close off the tube 21, i.e. disk 23'' perforations, otherwise.

The valve mouthpiece need not be constructed as a separate structure. Flapper valves 43 can instead be incorporated into the layers of cigarette filter material 45 to be normally closed, FIG. *5a,* thereby closing the filter 45 passageways, and to open only under a smoker's draw, FIG. *5b.*

The fibers of filter material 45 are bifurcated to form minute flaps 47, normally laying to close off the air flow and which then separate from the other portions of the fibers to open the minute passageways of the filter when subjected to a vacuum. These fiberous flaps 47 move only under sufficient pressure drop created by the smoker's draw.

As an alternative to the filter material of FIGS. *5a–b,* a blistered or hollow cell filter material 49 can be used, FIGS. *6a–b.*

With this filter material 49, the blister cells 51 are normally closed against one another, FIG. *6a,* but separate to allow the passage of smoke 37, under a smoker's draw, FIG. *6b.* These blister cells 51 are formed as part of the filter material 49 layering. They close off the filter passages and then swing away from one another under sufficient pressure drop to open the passageways.

A pressure drop or vacuum capable of raising a column of $\frac{3}{4}$ to $1\frac{1}{4}$ inches of water is considered a light draw, while a pressure drop to raise 2 to 3 inches of water is considered a medium draw and a pressure of 4 to 5 inches of water is considered a heavy draw force for a smoker to generate on the valved mouthpiece.

The above description is to be read and considered as illustrative and is not intended in the limited sense. Many other variations can be recited for the present invention without departing from the intent and scope thereof.

What is claimed is:

1. An extinguishing promoting cigarette, comprising:

a roll of smoking material;

an extinguishing promoting wrapper tube about said smoking material and containing same; and a mouthpiece attached to one end of said wrapper tube and said roll and continuous therewith, said mouthpiece including valving means normally closing off said mouthpiece and which opens only under a pressure differential applied there across by a reduced pressure applied to the free unattached end of said mouthpiece, wherein smoke which is intended to be drawn through said mouthpiece is able to pass without being diverted to a change in direction of flow, said mouthpiece adding to the draw pressure of said cigarette;

wherein said mouthpiece includes a cylinder member open at each end and wherein said valving means extends across an interior cross section of said cylinder and wherein said valving means is capable of opening to allow passage of smoke only in the direction of said free unattached end.

2. The cigarette of claim 1 wherein said reduced pressure is equal to at least $\frac{1}{8}$ inch of water, vacuum.

3. The cigarette of claim 1 wherein said reduced pressure is equal to at least $\frac{1}{4}$ inch of water, vacuum.

4. The cigarette of claim 1 wherein said reduced pressure is equal to at least $\frac{3}{4}$ inch of water, vacuum.

5. The cigarette of claim 1 wherein said valving means includes a solid disk extending across the interior of said hollow cylinder, said disk having a plurality of port therethrough, a plurality of valve members, each extending to close off a respective port and biased to the closed positions, said valve members opening in the direction of said free unattached mouthpiece end under gas flow initiated by said reduced pressure at said mouthpiece end.

6. The cigarette of claim 5 wherein said valve members only open in the direction of said mouthpiece end.

7. The cigarette of claim 6 wherein each said valve member is a valve flap attached to said disk surface, said flap being a sheet like structure seating against a respective disk hole and bending away therefrom under said reduced pressure induced gas flow and returning to reseat against said disk hole when said reduced pressure induced gas flow drops blow a threshold valve.

8. The cigarette of claim 6 wherein each said valve member is a bladder type valve mounted over each respective disk hole and opening under said reduced pressure induced gas flow.

9. The cigarette of claim 8 wherein said bladder valve includes puffed cells.

10. The cigarette of claim 1 wherein said mouthpiece contains a filter material filling a portion of said mouthpiece cylinder length and wherein said valving means includes a plurality of individual valve members each extending to close off a portion of said filter material passages.

11. A mouthpiece for a fire-safe cigarette, comprising;

a solid walled hollow cylinder open at either end;

means for closing off said hollow cylinder from the flow of gases and smoke therethrough; and means, automatically operative upon the pressure differential across said cylinder exceeding a predetermined value, operative to permit the flow of gases and smoke through said cylinder, said flow permitting means closing off said flow when said pressure differential drops below said predetermined threshold valve, wherein said closing off means includes a disk member extending across said hollow cylinder interior; and wherein said flow permitting means includes at least one passageway past said disk member and a pressure sensitive valve member biased to normally close off said passageway and opening when said pressure threshold difference is exceeded.

12. The mouthpiece of claim 11 wherein said pressure threshold difference is a $\frac{1}{8}$ inch of water.

13. The mouthpiece of claim 11 wherein said pressure threshold difference is $\frac{3}{4}$ inch of water.

14. A mouthpiece for a fire-safe smoke, comprising:

a solid walled hollow cylinder having both ends opened;

a porous filter material containing a plurality of passageways contained within and at least partially filling said hollow cylinder; and a plurality of valving members biased to normally close off each of said passageways through said filter material, said valving members opening upon a pressure differential across said mouthpiece exceeding a threshold value.

15. The mouthpiece of claim 14 wherein each of said valving members each open toward a first end of said mouthpiece when a pressure drop at said first end exceeds $\frac{1}{4}$ inches of water and are closed otherwise.

16. The mouthpiece of claim 14 wherein each of said valving members each open toward a first end of said mouthpiece when a pressure drop at said first end exceeds $1\frac{1}{4}$ inches of water and are otherwise closed.

* * * * *